US006282758B1

(12) United States Patent
Lin

(10) Patent No.: US 6,282,758 B1
(45) Date of Patent: Sep. 4, 2001

(54) LOCK ASSEMBLY FOR A ROLLER-BLADES

(76) Inventor: Jong-Yuan Lin, 1 Fl., No. 5, Lane 12, Ta-Chun Rd., Houli Hsiang, Taichung Hsien (TW)

( * ) Notice: Subject to any disclaimer, the term of this patent is extended or adjusted under 35 U.S.C. 154(b) by 0 days.

(21) Appl. No.: 09/466,363

(22) Filed: Dec. 17, 1999

(51) Int. Cl.[7] ..... A43C 11/00
(52) U.S. Cl. ..... 24/71 SK; 24/68 SK; 24/70 SK
(58) Field of Search ..... 24/71 SK, 70 SK, 24/69 SK, 68 SK, 115 G, 115 M, 115 N; 74/502.2

(56) References Cited

U.S. PATENT DOCUMENTS 4,651,392 * 3/1987 Olivieri ..... 24/71 SK
4,669,153 * 6/1987 Olivieri ..... 24/68 SK
5,575,045 * 11/1996 Chu ..... 24/71 SK
5,701,639 * 12/1997 Chen ..... 24/71 SK

* cited by examiner

*Primary Examiner*—Victor N. Sakran
(74) *Attorney, Agent, or Firm*—William E. Pelton, Esq.

(57) ABSTRACT

A lock assembly for roller-blades is disclosed. The lock assemble has a plate with a lock stub mounted thereon, a lock block pivotally mounted on the plate and at least one lock device mounted on the lock block. The block has a cavity corresponding to the stub of said plate, a hole for receiving each lock device and a passage connecting to the cavity being defined in a face of each hole. The lock device includes a positioning member with a stock extending through the corresponding passage, a plug securely pressed into the hole to seal it and a spring abutting the positioning member and the plug. The lock assembly can be locked and released in a one step operation so as to increase the convenience of operation.

3 Claims, 8 Drawing Sheets

LOCK ASSEMBLY FOR A ROLLER-BLADES

BACKGROUND OF THE INVENTION

1. Field of the Invention

The present invention relates to a lock assembly for roller-blades, and more particularly to a lock assembly that can be locked or released in a one step operation.

2. Description of Related Art

Referring to FIG. 5, roller-blades (40) have a boot (41), a lock assembly (50) mounted on the boot (41) to securely hold the user's foot in the boot (41) and a series of aligned rollers fixedly mounted on the under side of the boot (41). The conventional lock assembly (50), as shown in FIG. 6, includes a plate (51) attached to the boot (41), a lock block (52) pivotally attached to the plate (51) at a pivot (53), a locking tongue (57) slidably mounted in a slot (521) in the lock block (52) and at least one spring (58) located between the lock block (52) and the locking tongue (57). The plate (51) has a hook (511) formed on the distal end, and the locking tongue (57) has a latch catch (571) corresponding to the hook (511) to engage with it. One end of a belt (55) is pivotally connected to the lock block (52) with a pivot pin (54) to securely hold the boot (41) on the user's foot. A recess (524) is defined on the face of the slot (521) for receiving each spring (58). A channel (522) connecting to the slot (521) is defined on the side of the block (52) which faces the plate (51) for receiving the latch catch (571) of the locking tongue (57), such that the latch catch (571) can slide along the channel (522) corresponding to the lock block (52). The locking tongue (52) has at least one protrusion (572) formed thereon, and the lock block (52) has a hole (523) to receive each protrusion (572) so as to keep the locking tongue (57) from bouncing out of the slot (521).

By such an arrangement, the latch catch (571) will engage with the hook (511) when the lock block (52) abuts the plate (51), such that the belt (55) can bind around the boot (41) by the pull of the lock block (52).

Referring to FIGS. 6–8, when the user pushes the locking tongue (57) corresponding to the lock block (52), the latch catch (571) will move along the channel (522) and disengage from the hook (511). Then the lock block (52) can rotate relative to the fixed plate (51), and the belt (55) will loosen, such that the foot of the user can be inserted into or be taken out of the boot (41).

However, the conventional lock assembly (50) for roller-blades (40) has a complex structure, thus the cost for manufacturing and assembling the lock assembly (50) will increase. In addition, two operational steps in two different directions are required to disengage the lock assembly (50). Therefore, the operation of the conventional lock assembly (50) is inconvenient. Furthermore, the latch catch (571) cannot engage with the hook (511) if there is an elastic failure in the spring (58).

To overcome the shortcomings, the present invention tends to provide an improved lock assembly to mitigate or obviate the aforementioned problems.

SUMMARY OF THE INVENTION

The main objective of the invention is to provide a lock assembly for roller-blades having a plate with a lock stub mounted thereon, a lock block with a cavity for receiving the lock stub pivotally mounted on the plate and at least one lock device mounted on the lock block each including a positioning member, a plug and a spring abutting between said positioning member and said plug so that the lock assembly can be locked or released in one operation so as to increase the convenience of the operation.

Other objects, advantages and novel features of the invention will become more apparent from the following detailed description when taken in conjunction with the accompanying drawings.

DETAILED DESCRIPTION OF PREFERRED EMBODIMENT

Figure 1:
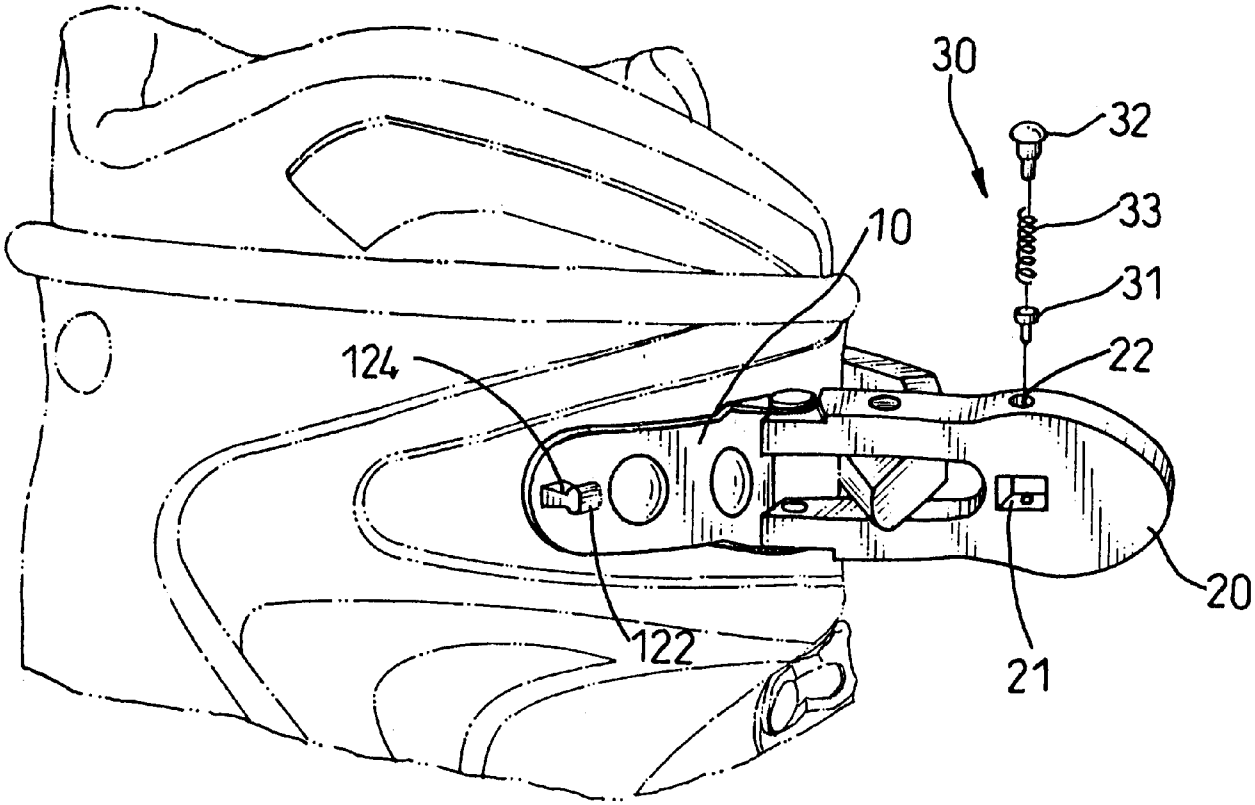
FIG. 1 is a perspective view of a lock assembly for roller-blades in accordance with the present invention.
Figure 2:
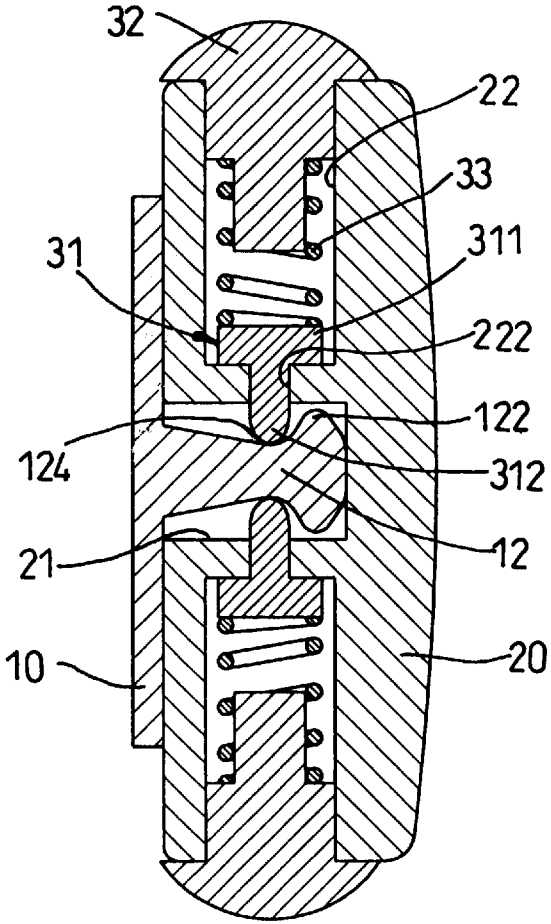
FIG. 2 is a side cross sectional plan view of the lock assembly in FIG. 1.

Referring to FIGS. 1 and 2, a lock assembly in accordance with the present invention comprises a plate (10) fixedly attached to the boot of a roller-blade skate, a lock block (20) pivotally mounted on the plate (10) and at least one lock device (30) mounted on the lock block (20). A lock stub (12) is fixedly mounted on the plate (10). The lock stub (12) has a base being mounted on the plate (10), a head (122) formed on the distal end thereof and a neck (124) formed at the junction of the base of the stub (12) and the head (122). Both the base and the head (122) of the stub (12) are larger than the neck (124). The lock block (20) has a cavity (21) corresponding to the lock stub (12) defined on the side facing the plate (10) for receiving the stub (12). A hole (22) with a passage (222) connecting to the cavity (21) is defined in the lock block (20) for receiving each lock device (30). The lock device (30) includes a positioning member (31) extending through the passage (222) into the cavity (21), a plug (32) pressed into the hole (22) to seal it and a spring (33) located between the positioning member (31) and the plug (32). The positioning member (31) has a stock (312) extending through the passage (222) into the cavity (21) to allow one end thereof to abut the neck (124) of the lock stub (12), and a head (311) formed on the other end of the stock (312) to abut the inner periphery of the passage (222) through which the stock (312) extends.

When the lock block (20) is rotated to abut to the plate (10), the lock stub (12) will insert into the cavity (21). Then the head (122) of the stub (12) will pass through the gap between the stocks (312) of the positioning members (31), and each stock (312) will abut the neck (124) of the lock stub (12). Thus, the lock block (20) will be held by the contact between the head (122) and the stock (312) of each positioning member (31), so that the lock assembly is locked.

Figure 3:
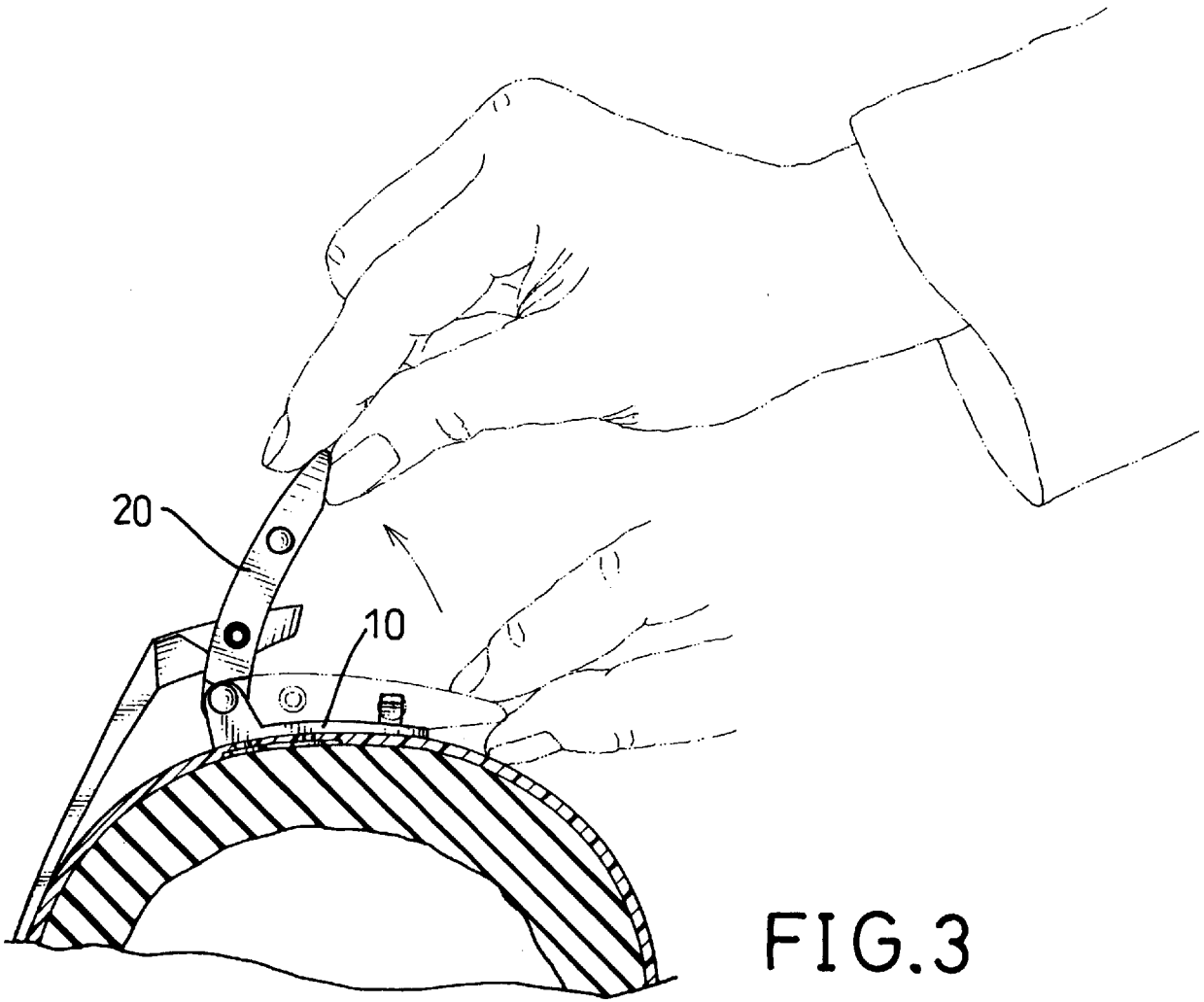
FIG. 3 is a schematic top plan view of the lock assembly in FIG. 1 with the lock block being pulled relative to the plate to release the lock assembly.
Figure 4:
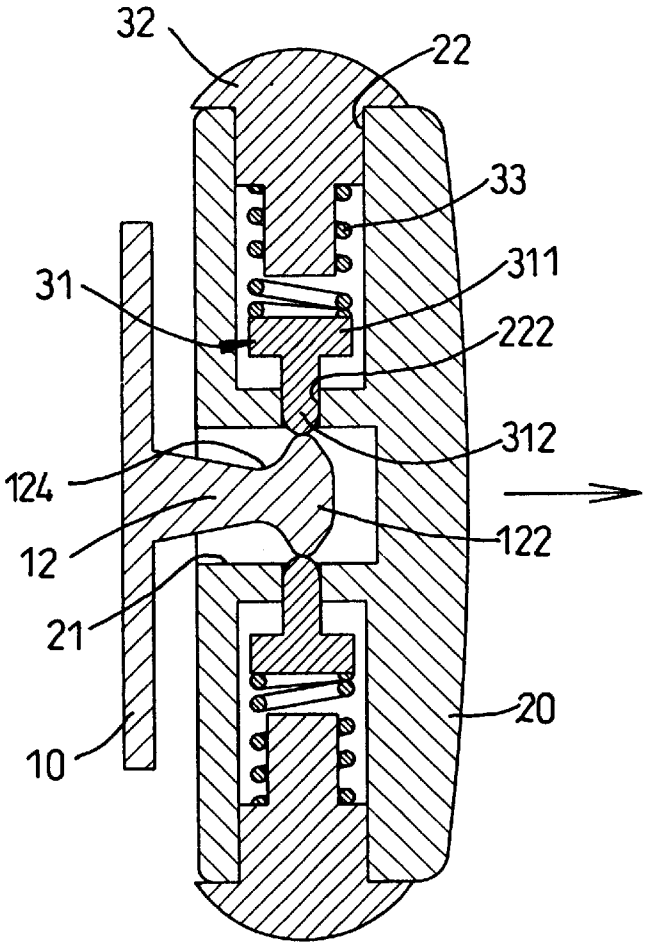
FIG. 4 is an operational side cross sectional plan view of the lock assembly in FIG. 1.
Figure 5:
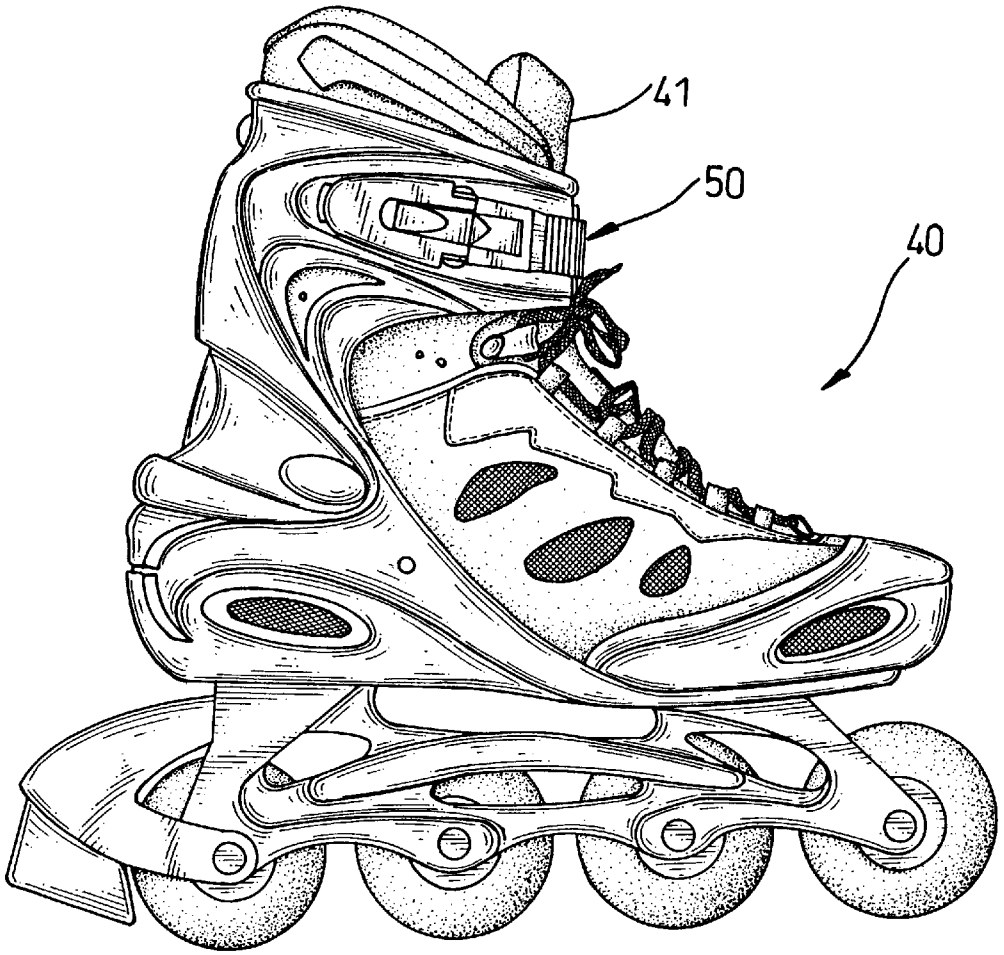
FIG.5 PRIOR ART
FIG. 5 is a side plan view of a roller-blade skate in accordance with the prior art.
Figure 6:
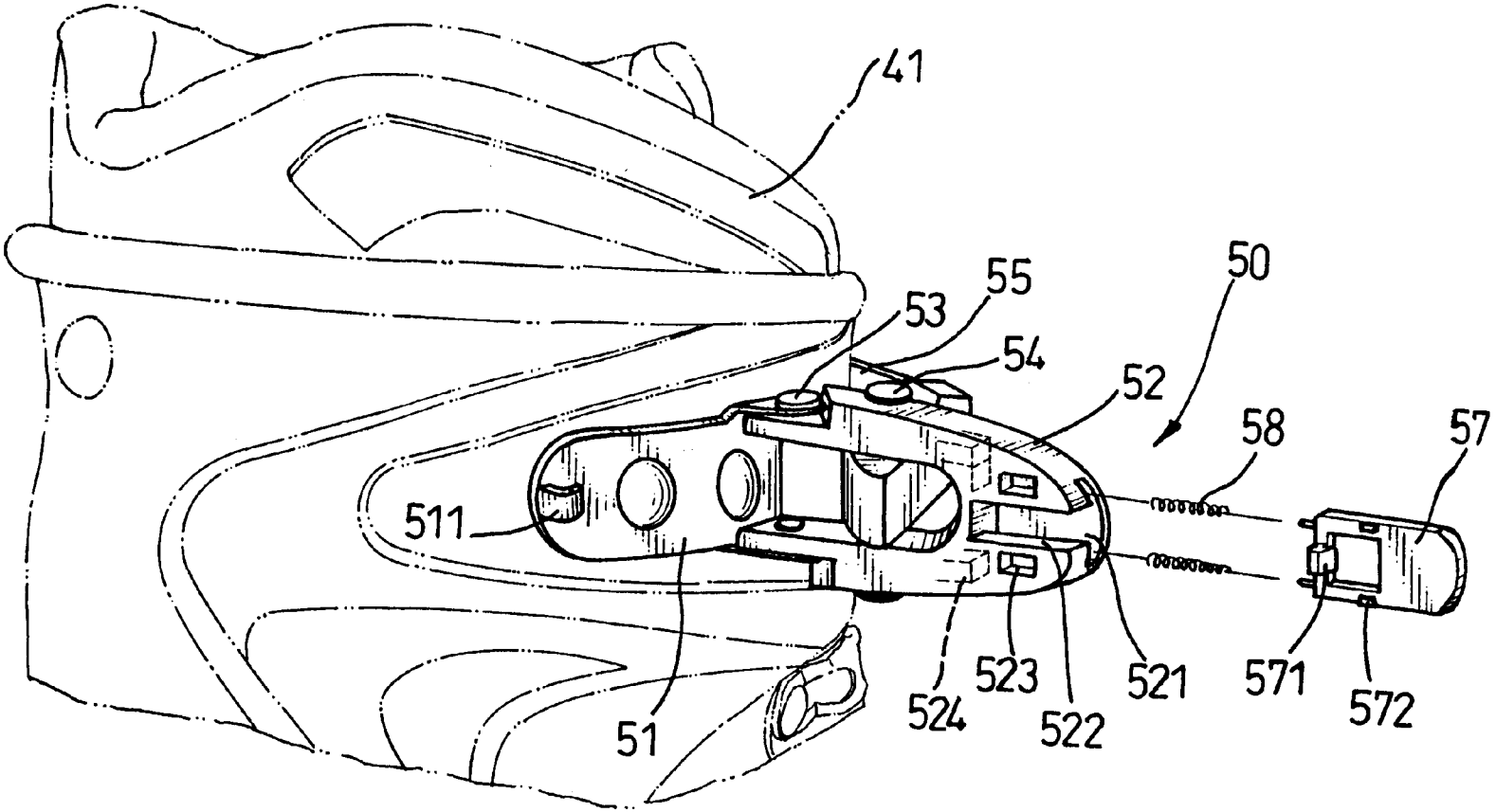
FIG.6 PRIOR ART
FIG. 6 is an exploded perspective view of a lock assembly in accordance with the prior art.
Figure 7:
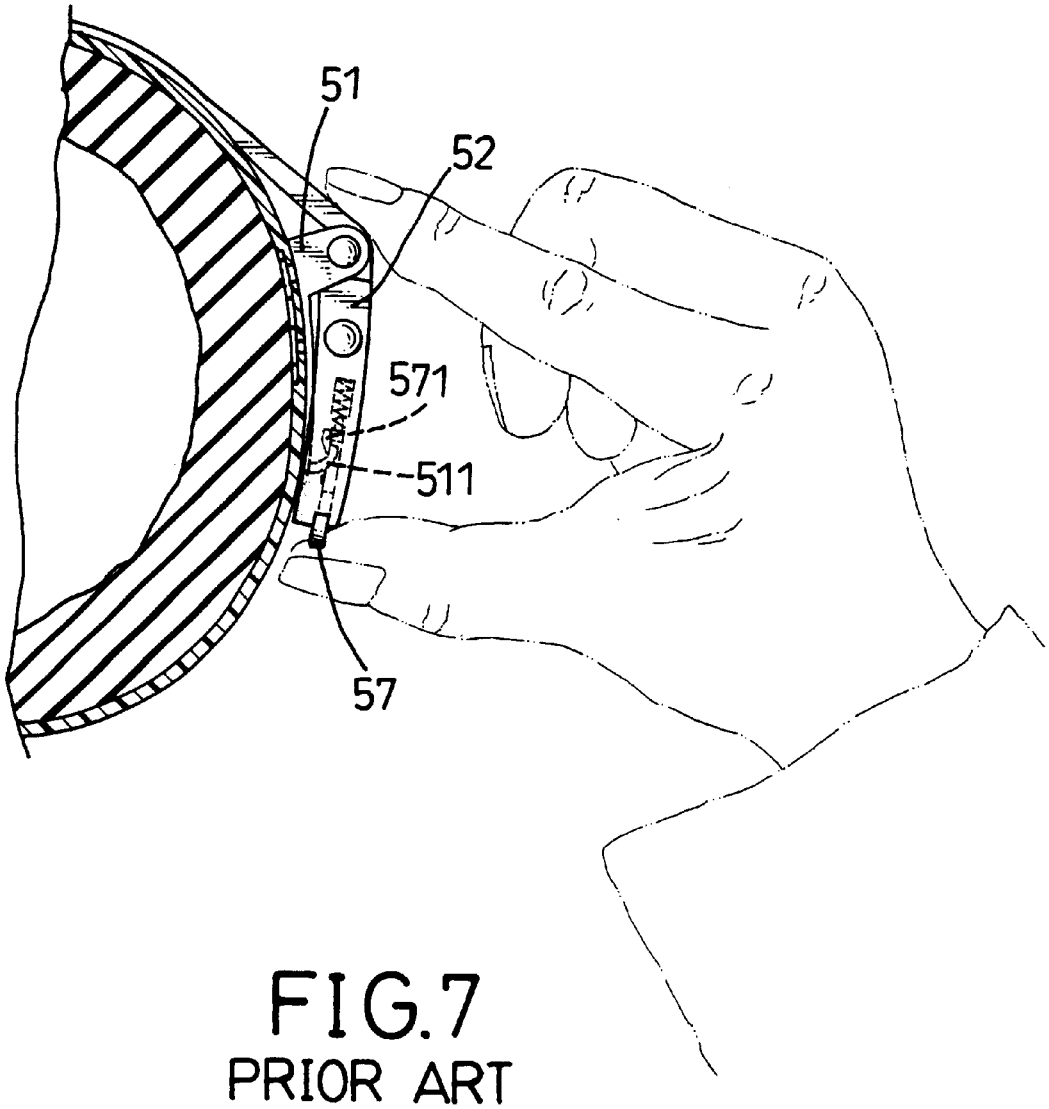
FIG.7 PRIOR ART
FIG. 7 is a schematic plan view of the lock assembly in FIG. 6 with the locking tongue being pushed corresponding to the lock block.
Figure 8:
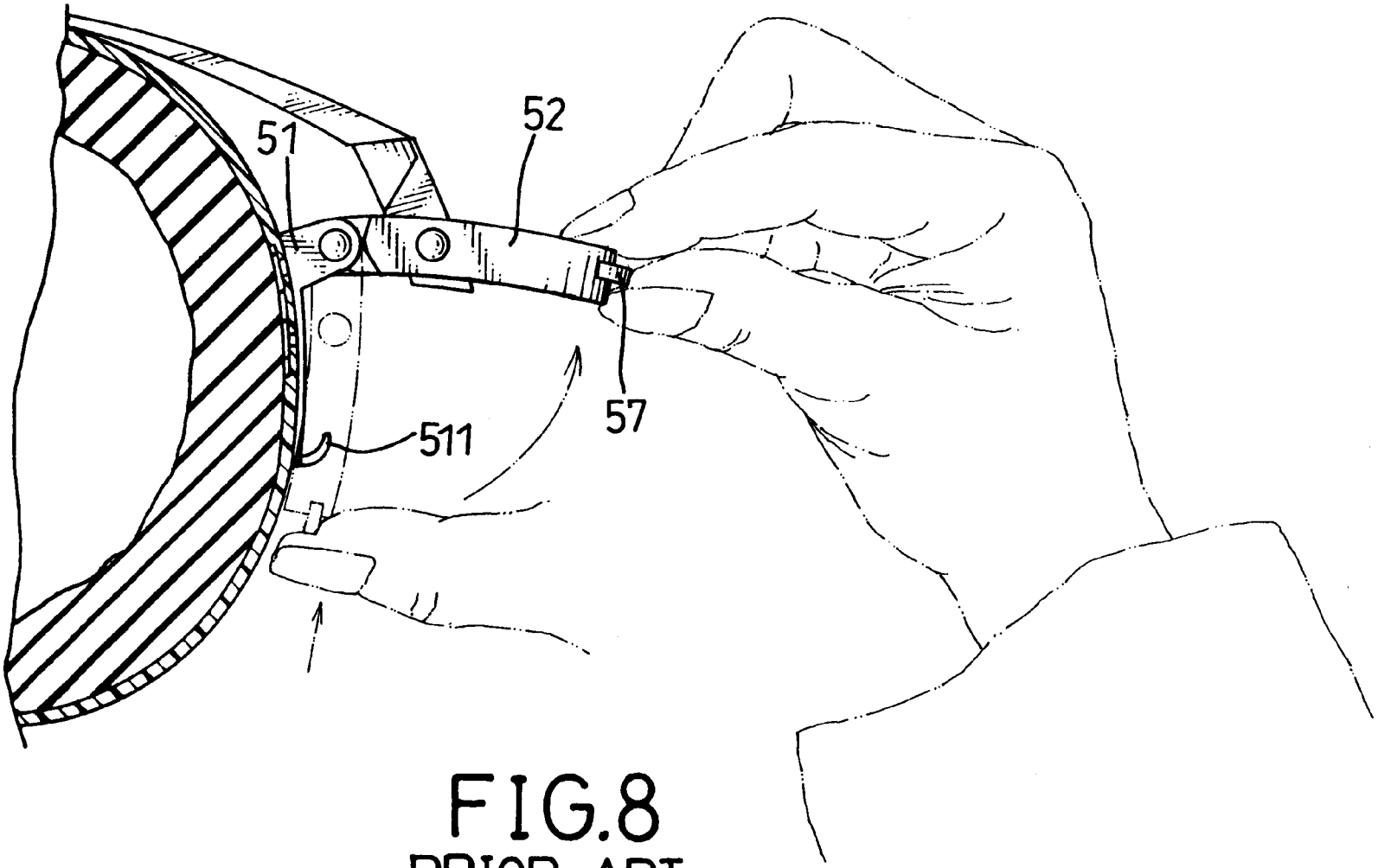
FIG.8 PRIOR ART
FIG. 8 is a schematic top plan view of the lock assembly in FIG. 6 with the lock block rotating relative to the plate.

Referring to FIGS. 3 and 4, when the lock block (20) is rotated to separate it from the plate (10), each stock (312)

will be pushed by the head (122) of the stub (12) and axially moved relative to the corresponding passage (222) such that the head (122) can pass through the gap between the stocks (312) of the positioning members (31), and the lock assembly is unlocked. Therefore, the lock assembly has can be locked or released with only one operational step so as to increase the convenience of operation. In addition, the simple structure of the lock assembly can improve the efficiency of manufacturing and assembling the lock assembly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lock assembly for a roller-blades comprising:

a plate having a lock stub mounted thereon;

a lock block pivotally mounted on said plate and having a cavity defined to correspond to said stub of said plate, at least one hole defined in said block and a passage defined in a face of each hole to communicate with said cavity;

a lock device received in each said hole, said lock device having a positioning member with a stock extending through said corresponding passage and into said cavity, a plug attached onto said hole to seal said hole and a spring abutting said positioning member and said plug.

2. The lock assembly as claimed in claim 1, wherein said lock stub has a head with a diameter larger than that of said stub and a neck a neck formed between said stub and said head for said stock abutting thereto.

3. The lock assembly as claimed in claim 1, wherein said positioning member has a head formed thereon to abutting an inner periphery of said passage through which said positioning member extends.

* * * * *